US005705459A

United States Patent [19]

Shiokawa et al.

[11] Patent Number: 5,705,459

[45] Date of Patent: Jan. 6, 1998

[54] PROCESS FOR THE PRODUCTION OF POLYOL ESTER AND ESTER-CONTAINING LUBRICATING OIL

[75] Inventors: Yoshihiro Shiokawa; Shunichi Matsumoto; Yoshifumi Sato; Kinji Kato; Mitsuharu Kitamura, all of Kurashiki, Japan

[73] Assignee: Mitsubishi Gas Chemical Company, Inc., Tokyo, Japan

[21] Appl. No.: 578,994

[22] Filed: Dec. 27, 1995

[30] Foreign Application Priority Data

Dec. 27, 1994 [JP] Japan ..... 6-324877
Dec. 28, 1994 [JP] Japan ..... 6-327530

[51] Int. Cl.[6] ..... C10M 105/32

[52] U.S. Cl. ..... 508/485; 252/67; 252/68

[58] Field of Search ..... 508/485; 252/67, 252/68

[56] References Cited

U.S. PATENT DOCUMENTS

| | | | |
|---|---|---|---|
| 4,992,189 | 2/1991 | Chen et al. | 508/485 |
| 5,342,533 | 8/1994 | Kondo et al. | 252/68 |
| 5,468,406 | 11/1995 | Schmid et al. | 508/485 |

*Primary Examiner*—Jacqueline V. Howard
*Attorney, Agent, or Firm*—Wenderoth, Lind & Ponack

[57] ABSTRACT

A process for the production of a high-performance hybrid polyol ester having excellent compatibility with hydrofluorocarbons which are regarded as the most likely refrigerant and having excellent resistance to hydrolysis which esters are liable to undergo, the polyol ester having a plurality of branched fatty acid residues at least one of which has a different number of carbon atoms from that of the other branched fatty acid residue or those of the other branched fatty acid residues, the process comprising reacting at least two kinds of olefins having different numbers of carbon atoms, carbon monoxide and a polyhydric alcohol in the presence of hydrogen fluoride.

3 Claims, No Drawings

PROCESS FOR THE PRODUCTION OF POLYOL ESTER AND ESTER-CONTAINING LUBRICATING OIL

FIELD OF THE INVENTION

The present invention relates to a process for the production of a polyol ester used in jet engine oil, low-temperature-use grease, heat-resistant engine oil, refrigerator oil and other oils, and an ester-containing lubricating oil suitable for use as a refrigerator oil. More specifically, it relates to a process for the production of a polyol ester from an olefin, carbon monoxide and a polyhydric alcohol, and an ester-containing lubricating oil which has excellent compatibility with hydrofluorocarbon and is excellent in hydrolysis resistance and stability against heat.

PRIOR ART OF THE INVENTION

A polyol ester has been hitherto produced by esterification-reacting a fatty acid with a polyhydric alcohol under heat, as is disclosed in JP-A-5-25484 and JP-A-5-70789. It is known that this reaction proceeds at a low rate even if the reaction is carried out at a high temperature of 200° C. or higher. When this reaction is industrially carried out, it is required to use a high-capacity reactor.

For avoiding the above reaction required to be carried out at a high temperature for a long period of time, JP-A-4-314793, JP-A-5-271676 and JP-A-5-1291 disclose a method in which a polyol ester is produced through an acid chloride.

In the method carried out through an acid chloride, however, an acid chloride is prepared from a fatty acid, and an acid chloride such as phosphorus trichloride, phosphorus pentachloride or thionyl chloride is required. In this case, therefore, the handling of the acid chloride is not easy, and the production process is complicated.

When used, for example, as a refrigerator oil, polyol esters obtained by the above methods have good compatibility with chlorine-free hydrofluorocarbons which are regarded as the most likely novel refrigerant, while these polyol esters are still not yet satisfactory in hydrolysis resistance and stability against heat.

As a refrigerant for a refrigerator, chlorine-containing chlorofluorocarbons and hydrochlorofluorocarbons have been widely used.

In recent years, however, it has been found that chlorine contained in the above refrigerant destroys the ozone layer of the stratosphere, and the restriction of use of chlorofluorocarbons and hydrochlorofluorocarbons has been being globally tightened up, and the use of chlorine-free hydrofluorocarbons is therefore considered the most likely alternative as a refrigerant.

On the other hand, it has been proved that mineral oil-containing or alkylbenzene-containing refrigerator oils which have been so far used cannot be used with hydrofluorocarbons due to poor compatibility.

As a substitute refrigerator oil, polyol ester-containing refrigerator oils excellently compatible with hydrofluorocarbons are being studied, while the defect of the ester is that it undergoes hydrolysis in the presence of water. It is therefore an urgent demand to develop an ester having excellent resistance to hydrolysis.

It is known that a polyol ester obtained from a carboxylic acid having a secondary or tertiary carbon in the α-position of its carbonyl group is excellent in hydrolysis resistance and stability against heat, and refrigerator oils based on the said polyol ester are disclosed in JP-A-4-314793, JP-A-5-1291, JP-A-5-17787, U.S. Pat. No. 5,202,044 and JP-A-5-17789.

As described above, in conventional methods of producing polyol esters, when a fatty acid and a polyhydric alcohol are reacted, the reaction rate is greatly low even at a temperature of 200° C. or higher, and in the method of forming a polyol ester through an acid chloride, there is a problem in the handling and complicated production process due to the use of an acid chloride.

Conventional polyol ester-containing refrigerator oils have good compatibility with hydrofluorocarbons as a novel refrigerant, while esters are easily hydrolyzed in the presence of water, so that it is desired to develop esters having high hydrolysis resistance. It is also desired to develop esters having improved stability against heat.

SUMMARY OF THE INVENTION

It is an object of the present invention to provide a process for the production of a high-performance hybrid polyol ester having excellent compatibility with hydrofluorocarbons which are regarded as the most likely refrigerant and having excellent resistance to hydrolysis which esters are liable to undergo.

It is another object of the present invention to provide a process for the production of a hybrid polyol ester, which can be carried out at a low temperature for a short period of time without employing a reaction between a fatty acid and a polyhydric alcohol or employing a method carried out through an acid chloride.

It is further another object of the present invention to provide a process for the production of a hybrid polyol ester in which the polyol ester is formed from a polyol and at least two kinds of olefins and all the α carbons adjacent to carbonyl groups are secondary and/or tertiary carbon atoms.

It is still further another object of the present invention to provide a hybrid polyol ester-containing lubricating oil which is excellently compatible with hydrofluorocarbons used as a refrigerator refrigerant and is excellent in hydrolysis resistance and stability against heat.

It is yet another object of the present invention to provide a process for producing a hybrid polyol ester-containing lubricating oil excellent in compatibility, hydrolysis resistance and stability against heat from butene, octene, carbon monoxide, hydrogen fluoride and pentaerythritol at a low temperature for a short period of time.

According to the present invention, the above objects and advantages of the present invention are achieved, first, by a process for the production of a polyol ester having a plurality of branched fatty acid residues at least one of which has a different number of carbon atoms from that of the other branched fatty acid residue or those of the other branched fatty acid residues, which comprises reacting at least two kinds of olefins having different numbers of carbon atoms, carbon monoxide and a polyhydric alcohol in the presence of hydrogen fluoride.

According to the present invention, further, the above objects and advantages of the present invention are achieved by an ester-containing lubricating oil containing, as a base oil, a mixture of polyol esters having a plurality of fatty acid residues in which alkyl groups bonding to carbonyl groups are linear and derived from butene and octene, and atoms in α-positions relative to the carbonyl groups are secondary and/or tertiary carbon atoms.

DETAILED DESCRIPTION OF THE INVENTION

The present inventors have made diligent studies for an industrial process for the production of a polyol ester, and have found the following. By reacting at least two kinds of olefins, carbon monoxide and a polyhydric alcohol in the presence of hydrogen fluoride, there can be obtained an ester having mixed fatty acid residues, i.e., a hybrid polyol ester, at a low temperature for a short period of time, and this hybrid polyol ester is a high-performance ester having excellent compatibility with hydrofluorocarbons regarded as the most likely substitute refrigerant for chlorofluorocarbons and having excellent hydrolysis resistance. On the basis of this finding the present invention has been arrived at (to be referred to as "the present invention 1" hereinafter).

The present inventors have further studied polyol ester-containing lubricating oils, and as a result have found the following. A hybrid polyol ester having branched fatty acid residues derived from butene and octene can be obtained by synthesizing branched fatty acid fluoride mixture from butene, octene, carbon monoxide and hydrogen fluoride and reacting the branched fatty acid fluoride mixture with a polyhydric alcohol, and the so-obtained polyol ester has excellent compatibility with hydrofluorocarbons regarded as the most likely substitute for chlorofluorocarbons since fatty acid residues having 5 and 9 carbon atoms are intermixed and randomly bonding. Further, the hybrid polyol ester is excellent in hydrolysis resistance and stability against heat, since the hybrid polyol ester is a mixture of ester compounds having a plurality of ester groups each, in which carbon atoms in α-positions relative to carbonyl groups are secondary and/or tertiary carbon atoms and all the alkyl groups bonding to the carbon atoms in the α-positions are linear. On the basis of this finding, the present invention has been arrived at (to be referred to as "the present invention 2" hereinafter).

The present inventors have further found that a polyol ester obtained from the above fatty acid fluoride and pentaerythritol as the above polyhydric alcohol is more excellent in compatibility with hydrofluorocarbons, hydrolysis resistance and stability against heat.

The above prior art documents disclose an ester from a branched carboxylic acid in which the carbon atom in its α-position is a secondary or tertiary carbon atom, an acid derivative thereof and a polyhydric alcohol. Examples of the carboxylic acid and the acid derivative thereof include 2-ethyl-2,3,3-trimethylbutanoic acid and 2-isopropyl-2,3-dimethylbutanoic acid JP-A-5-271676 (JP-A-5-1291. However, this ester is essentially different from an isomer mixture of a polyol ester derived from butene or octene, provided by the present invention since most carboxylic acids described in the prior art have a branch in a position other than the α-position as well as a branch in the α-position.

The olefins used in the present invention 1 preferably have 3 to 10 carbon atoms, preferably 3 to 8 carbon atoms. Examples of the olefins include propylene, butylene, isobutylene, pentene, hexene and octene. At least two kinds of olefins are used for the reaction.

The polyhydric alcohol used in the present invention 1 preferably has 2 to 6 hydroxyl groups. Examples of the polyhydric alcohol include neopentyl glycol, trimethylolethane, trimethylolpropane and pentaerythritol.

The molar amount of the hydrogen fluoride used in the present invention 1 is 5 to 30 times, preferably 7 to 15 times, the molar amount of the olefins. When the molar amount of the hydrogen fluoride is smaller than 5 times, a side reaction amount increases, and the yield of the polyol ester is low.

When the above amount of the hydrogen fluoride exceeds 30 mol, economically disadvantageously, there is no further improvement in the yield, and the volume of a reactor increases.

Although differing depending upon olefins used, the temperature for the reaction between the olefins and carbon monoxide is generally −30° to 70° C., preferably −20° to 50° C. When the reaction temperature is too high, the amount of byproducts increases, and the yield decreases. When the reaction temperature is too low, the carbonylating reaction rate is low, and the volume of a reactor increases.

The reaction pressure of the reaction between the olefins and carbon monoxide in hydrogen fluoride is up to 100 $kg/cm^2$ G, preferably 10 to 80 $kg/cm^2$ G. When the reaction pressure is low, the yield of acyl fluoride as an intermediate is low. When the reaction pressure is increased to higher than 100 $kg/cm^2G$, there is almost no improvement in the yield, and industrially disadvantageously, the reaction facilities require an additional cost.

The above reaction pressure is applied when carbon monoxide having a high purity is used. When the carbon monoxide for use contains a considerable amount of inert gas, the partial pressure of the carbon monoxide should be brought into the above reaction pressure range. The amount of the carbon monoxide is determined depending upon the reaction pressure.

The molar amount of the polyhydric alcohol (molar amount of OH groups of the polyhydric alcohol) is 2 times at the largest, preferably 0.7 to 1.5 times, as large as the molar amount of the olefins. When the amount of the polyhydric alcohol is greater than the above upper limit, undesirably, the resultant ester has a high hydroxyl value and is liable to undergo hydrolysis. When the amount of the polyhydric alcohol is smaller than the above lower limit, uneconomically, a large amount of acyl fluoride as an intermediate formed from the olefins and carbon monoxide remains.

The process of the present invention can carried out by any one of a method (1) in which at least two kinds of olefins and carbon monoxide are reacted in hydrogen fluoride and then the reaction product is reacted with a polyhydric alcohol, a method (2) in which at least two kinds of olefins, hydrogen fluoride, carbon monoxide and a polyhydric alcohol are reacted by introducing the at least two kinds of olefins into a reactor containing the hydrogen fluoride, the carbon monoxide and the polyhydric alcohol, and a method (3) in which hydrogen fluoride, carbon monoxide, at least two kinds of olefins and a polyhydric alcohol are reacted by simultaneoulsy introducing the at least two kinds of olefins and the polyhydric alcohol into a reactor containing the hydrogen fluoride and the carbon monoxide. Of these methods, the method (1) gives the highest ester yield.

In the method (1), the method of introducing at least two kinds of olefins can be classified into a) a method in which the olefins are simultaneously introduced into one reactor through separate lines, b) a method in which the olefins are mixed in advance and the mixture is introduced into a reactor, and c) a method in which reactors are provided for the olefin, one reactor for one olefin, to separately form acyl fluorides as an intermediate and the acyl fluorides are mixed at the time of esterification. The above method c) is not industrially advantageous since the production facilities cost much, and the methods a) and b) are preferred.

In the above method (1), a mixture of acyl fluorides formed from at least two kinds of olefins and carbon monoxide is reacted with the polyhydric alcohol under elevated pressure or atmospheric pressure, and the reaction temperature is −10° to 70° C., preferably 0° to 50° C.

In the above method (2), the reaction is carried out under an elevated pressure of the carbon monoxide. The reaction temperature is preferably 0° C. or lower, since a polyhydric alcohol sometimes undergoes polycondensation in the presence of hydrogen fluoride.

In the above method (3), the reaction pressure and the reaction temperature may be the same as those in the method (1).

In the method (1), further, a reaction mixture from the acyl fluoride as an intermediate and hydrogen fluoride may be purified by prior distillation under the reflux of a saturated hydrocarbon which has a higher boiling point than the acyl fluoride and is inert to the acyl fluoride, before the esterification, for further simplifying the distillation of a crude ester to be obtained. The saturated hydrocarbon is selected from hexane, heptane, octane, nonane and decane. This prior distillation makes the purification of the crude ester easier.

Like the distillation of the above reaction mixture from hydrogen fluoride and acyl fluoride, the reaction mixture obtained by the esterification, obtained by the process of the present invention, is distilled under the reflux of a saturated hydrocarbon which has a higher boiling point than the acyl fluoride and is inert to the acyl fluoride, whereby acyl fluoride can be separated and recycled. Some of the so-obtained esters may be poured into ice water to separate them into an oil layer and an aqueous layer on the basis of their specific gravity difference, whereby the polyol ester as an end product is obtained.

The polyol ester obtained by the esterification can be purified by a conventional method such as washing with an alkali, purification by distillation, adsorption treatment or hydrogenation treatment.

When the polyol ester obtained by the process of the present invention is used as a refrigerator oil, conventional additives such as an antioxidant, an abrasion preventer and an epoxy compound may be incorporated as required.

The kinetic viscosity of the polyol ester produced by the process of the present invention may be adjusted depending upon the temperature and pressure conditions of the above carbonylating reaction or by changing the mixing ratio of a plurality of the olefins. Further, a required kinetic viscosity may be obtained by mixing a plurality of hybrid polyol esters produced separately.

For example, when a hybrid polyol ester produced by the process of the present invention using two kinds of olefins as raw materials and a mixture of polyol esters produced by carbonylating the above olefins separately and then esterifying them are compared where the kinetic viscosity of the hybrid polyol ester and that of the mixture are the same, the hybrid polyol ester produced by the process of the present invention has broader amount and temperature ranges in which the hybrid polyol ester has excellent compatibility with hydrofluorocarbons, than a mixture of polyol esters. That is, the hybrid polyol ester produced by the process of the present invention is presumably improved in compatibility with hydrofluorocarbons due to the presence of each of the branched fatty acid residues.

In the synthesis of a polyol ester in the present invention, a mixture of acyl fluorides formed from at least two kinds of olefins and carbon monoxide is sterically disadvantageous since all the carbon atoms in α-positions adjacent to carbonyl groups are secondary and/or tertiary carbon atoms, while the reaction between the acyl fluorides and the polyhydric alcohol is instantaneously completed even at a low temperature, and there is found no difference between the reaction rate of acyl fluoride having one molecular weight or one form of branching and that of acyl fluoride having another molecular weight or another form of branching. In this point, the esterification in the present invention greatly differs from a conventional esterification of a fatty acid and a polyhydric alcohol.

The present invention 2 is directed to an ester-containing lubricating oil containing, as a base oil, a mixture of polyol esters having a plurality of fatty acid residues in which alkyl groups bonding to carbonyl groups are linear and derived from butene and octene, and atoms in α-positions relative to the carbonyl groups are secondary and/or tertiary carbon atoms.

In the present invention, a mixture of polyol esters of the general formula (I) has desirable properties as an ester-containing lubricating oil. In the formula (I), each of $R^1$ to $R^4$ is an alkyl group derived from butene or octene, and all the carbons in α-positions are secondary or tertiary carbon atoms. Each branched chain is a linear group or hydrogen.

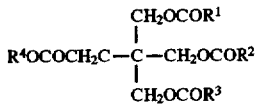

$$R^4OCOCH_2C-\underset{\underset{CH_2OCOR^3}{|}}{\overset{\overset{CH_2OCOR^1}{|}}{C}}-CH_2OCOR^2 \quad (I)$$

In particular, when butene and octene as raw materials are used in an octene/butene molar ratio of 1.50~1.70 for preparing branched fatty acid fluorides, a lubricating oil containing polyol esters of the general formula (I) having the following compositions is obtained and has excellent performances.

When the octene/butene molar ratio is smaller than the above lower limit, the number of fatty acid residues derived from butene (having 4 carbon atoms) increases to degrade hydrolysis resistance. When the octene/butene molar ratio is greater than the above upper limit, the number of fatty acid residues derived from octene (having 8 carbon atoms ) increases to narrow the amount and temperature ranges in which the polyol ester is excellent in compatibility with hydrofluorocarbons. As will be shown later in Comparative Examples, the polyol ester shows improved compatibility with hydrofluorocarbons when the polyol ester contains a combination of fatty acid residue derived from butene and fatty acid residue derived from octene.

That is, a polyol ester-containing lubricating oil containing, as a base oil, the following mixture is excellent in compatibility with hydrofluorocarbons and is excellent in hydrolysis resistance and stability against heat. The mixture contains ① not more than 2% by weight of a polyol ester of the general formula (I) in which each of $R^1$ to $R^4$ is an alkyl group having 4 carbon atoms, ② 10 to 20% by weight of a polyol ester of the general formula (I) in which each of $R^1$ to $R^3$ is an alkyl group having 4 carbon atoms and $R^4$ is an alkyl group having 8 carbon atoms, ③ 25 to 37% by weight of a polyol ester of the general formula (I) in which each of $R^1$ and $R^2$ is an alkyl group having 4 carbon atoms and each of $R^3$ and $R^4$ is an alkyl group having 8 carbon atoms, ④ 29 to 40% by weight of a polyol ester of the general formula (I) in which $R^1$ is an alkyl group having 4 carbon atoms and each of $R^2$ to $R^4$ is an alkyl group having 8 carbon atoms and ⑤ 10 to 20% by weight of a polyol ester of the general formula (I) in which each of $R^1$ to $R^4$ is an alkyl group having 8 carbon atoms.

As described already, the ester-containing lubricating oil of the present invention is produced by synthesizing a mixture of branched fatty acid fluorides from butene, octene, carbon-monoxide and hydrogen fluoride (carbonylation step) and then reacting the mixture of branched fatty acid fluorides with a polyhydric alcohol, particularly preferably with pentaerythritol (esterification step).

When compared with a mixture of a tetraester derived from butene and tetraester derived from octene, obtained by carbonylating butene and octene separately from each other and reacting the resultant carbonylation products with pentaerythritol, at the same temperature under the condition where the kinetic viscosity is the same, the mixture of polyol esters of the present invention has broader amount range in which the mixture has excellent compatibility with hydrofluorocarbons.

The reason for the above is assumed as follows. In the present invention, a mixture of acid fluorides is prepared from butene and octene in the carbonylation step, and then the mixture is reacted with pentaerythritol, whereby there is formed a mixture of hybrid esters having molecules each of which has randomly introduced branched fatty acid residues derived from butene or octene, and the mixture of polyol esters have improved compatibility with hydrofluorocarbons due to the presence of these branched fatty acid residues.

The molar amount of hydrogen fluoride in the carbonylation step is 5 to 30 times, preferably 7 to 15 times, as large as the total molar amount of butene and octene like that in the present invention 1.

The reaction pressure is 100 kg/cm$^2$ G or less, preferably 10 to 80 kg/cm$^2$ G like that in the present invention 1.

The molar amount of the polyhydric alcohol (molar amount of OH groups of the polyhydric alcohol), e.g., the molar amount of pentaerythritol (molar amount of OH groups of pentaerythritol), in the esterification step is 2 times or less, preferably 0.7 to 1.5 times as large as the molar amount of butene and octene. When the molar amount of the polyhydric alcohol is greater than the above, the resultant ester has too high a hydroxyl value and is liable to undergo hydrolysis. When the molar amount of the polyhydric alcohol is too small, uneconomically, a large amount of the branched fatty acid fluorides remain.

The kinetic viscosity of the polyol ester can be adjusted by changing the molar ratio of butene and octene. It can be also adjusted by the reaction temperature and the reaction pressure in the carbonylation step.

The mixture of polyol esters obtained by the above reaction can be purified by a conventional method such as washing with an alkali, purification by distillation, adsorption treatment or hydrogenation treatment like that in the present invention 1. When the polyol ester-containing lubricating oil of the present invention is used as a refrigerator oil, conventional additives such as an antioxidant, an abrasion preventer and an epoxy compound may be incorporated as required.

According to the present invention, there is provided a process for producing a polyol ester from at least two kinds of olefins, carbon monoxide and a polyhydric alcohol at a low temperature for a short period of time. According to the present invention, there is provided a process for producing a hybrid polyol ester from at least two kinds of olefins. The polyol ester has excellent compatibility with hydrofluorocarbons regarded as the most likely substitute for chlorofluorocarbons, and it is excellent in hydrolysis resistance and stability against heat since all the carbon atoms in the α-positions adjacent to carbonyl groups are secondary or tertiary carbon atoms.

The polyol ester-containing lubricating oil of the present invention has remarkably excellent hydrolysis resistance and stability against heat since an increase thereof in acid value is prevented even in a test carried out at a high temperature for a long period of time as long as 28 days, as will be described later. Further, the polyol ester-containing lubricating oil of the present invention has broad amount and temperature ranges in which it is excellent in compatibility with hydrofluorocarbons.

Further, conventional ester-containing lubricating oils are obtained by esterifying reactions between various fatty acids and alcohols, while the polyol ester-containing lubricating oil of the present invention can be industrially advantageously produced by a reaction of butene, octene, carbon monoxide, hydrogen fluoride and a polyhydric alcohol, preferably, pentaerythritol at a low temperature for a short period of time.

EXAMPLES

The present invention will be explained with reference to Examples hereinafter, while the present invention shall not be limited to these Examples.

In Examples, polyol esters were tested for hydrolysis resistance and compatibility with a refrigerant R-134a (1,1,1,2-tetrafluoroethane), one of hydrofluorocarbons regarded as the most likely substitute for chlorofluorocarbons, as follows.

(Hydrolysis Resistance Test)

A test tube made of glass was charged with polyol ester as a sample and with a 8 cm long iron wire, a 8 cm long copper wire and a 8 cm long aluminum wire, and a water content in the test tube was adjusted to 1,000 ppm, to prepare 10 g of a lubricating oil. 2 Grams of a refrigerant (R-134a, supplied by Daikin Industries, Ltd.) was added, and the test tube was sealed. The closed test tube was heated at 175° C. for 28 days, and then the mixture was measured for an acid value.

(Test of Compatibility with Refrigerant R-134a)

A glass tube was charged with 0.2 g of a polyol ester as a sample and 1.8 g of a refrigerant (R-134a, supplied by Daikin Industries, Ltd.), and sealed. The glass tube was heated at a temperature elevation rate of 1° C./minute or cooled at a temperature decrease rate of 1° C./minute, and the heating or cooling was started at 20° C. In this manner, the mixture was observed for a two-phase separation on a high-temperature side or on a low-temperature side.

Example 1

Esters were produced with two 1-liter stainless steel autoclaves each of which had a stirrer, three inlet nozzles in an upper portion and one outlet nozzle in a bottom portion and was so arranged that the temperature inside was controlled with a jacket, as an acyl fluoride reactor and an esterification reactor.

First, one autoclave (acyl fluoride reactor) was flushed with carbon monoxide, and then 210 g (10.5 mol) of hydrogen fluoride was introduced. The temperature inside the autoclave was cooled to −10° C., and the pressure inside the autoclave was elevated up to 20 kg/cm$^2$ G with carbon monoxide. While the temperature of −10° C. was maintained and while carbon monoxide was introduced so as to maintain the above pressure, 33.6 g (0.4 mol) of 1-hexene and 44.8 g (0.4 mol) of 1-octene were simultaneously fed through a gaseous phase in the autoclave over about 30 minutes. Further, after the feeding was completed, the mixture was continuously stirred for about 20 minutes until the absorption of carbon monoxide was no longer found. The amount of absorbed carbon monoxide was 17.1 g (0.61 mol) based on a weight difference in a carbon monoxide measuring tank.

The above-obtained acyl fluoride reaction mixture was recharged into the other autoclave (esterification reactor), and under atmospheric pressure, 25.5 g (0.19 mol) of trimethylolpropane was fed into the autoclave with a pump over about 30 minutes. The mixture was stirred at a reaction temperature of 0° C. for 2 hours. After the reaction was completed, the reaction mixture was poured into ice water, and an oily layer was recovered.

The oily layer was washed and purified by distillation to give a hybrid triester having a kinetic viscosity, at 40° C., of 25 cst and an acid value of 0.01 mgKOH/g. The triester was subjected to the hydrolysis resistance test for 28 days to show an acid value of 0.45 mgKOH/g. The triester was subjected to the test of compatibility with R-134a to show that the separation temperature on a low-temperature side was −60° C. or lower and that on a high-temperature side was 80° C. or higher.

Comparative Example 1

1-Hexene and 1-octene were independently carbonylated and esterified in the same reactor as that in Example 1 under the same conditions as those in Example 1 to give two kinds of triesters. The triester from 1-hexene and the triester from 1-octene were mixed in a mixing weight ratio of 2/3 (triester from 1-hexene/triester from 1-octene) to give a triester mixture having a kinetic viscosity, at 40° C., of 25 cst and an acid value of 0.01 mgKOH/g. The triester was subjected to the hydrolysis resistance test for 28 days to show an acid value of 0.50 mgKOH/g. The triester was subjected to the test of compatibility with R-134a to show that the separation temperature on a low-temperature side was −30° C. and that on a high-temperature side was 80° C. or higher.

Comparative Example 2

A 1-liter four-necked flask was equipped with a stirrer, a thermometer, a nitrogen-introducing tube and a dehydration tube with a condenser, and was charged with 2-methylhexanoic acid, 2-methylpentanoic acid and 3,5,5-trimethylhexanoic acid so that these components in this order had a weight ratio of 25/10/65. Then, trimethylolpropane was charged into the flask such that the amount of the trimethylolpropane (molar amount of OH groups of trimethylolpropane) and the total amount of the above-charged fatty acids were equimolar. Under the current of nitrogen, the mixture was subjected to an esterifying reaction at 240° C. for 10 hours to give a triester into which residues of a mixture of 2-methylhexanoic acid, 2-ethylpentanoic acid and 3,5,5-trimethylhexanoic acid were randomly introduced. After purified, the triester was measured for a kinetic viscosity and an acid value, to show a kinetic viscosity, at 40° C., of 32 cst and an acid value of 0.01 mgKOH/g. The triester was subjected to the hydrolysis resistance test for 28 days to show an acid value of 3.0 mgKOH/g. The triester was subjected to the test of compatibility with R-134a to show that the separation temperature on a low-temperature side was −56° C. and that on a high-temperature side was 80° C. or higher.

Example 2

A hybrid tetraester was synthesized in the same manner as in Example 1 except that the 1-hexene was replaced with 1-butene and that the trimethylolpropane was replaced with pentaerythritol. The triester showed a kinetic viscosity, at 40° C., of 69 cst and an acid value of 0.01 mgKOH/g. The triester was subjected to the hydrolysis resistance test for 28 days to show an acid value of 0.47 mgKOH/g. The triester was subjected to the test of compatibility with R-134a to show that the separation temperature on a low-temperature side was −20° C. and that on a high-temperature side was 80° C. or higher.

Example 3

Esters were produced with a stainless steel autoclave which had a stirrer, three inlet nozzles in an upper portion and one outlet nozzle in a bottom portion and was so arranged that the temperature inside was controlled with a jacket.

First, the autoclave was flushed with carbon monoxide, and then hydrogen fluoride was introduced and cooled to 5° C. The pressure inside the autoclave was elevated up to 20 kg/cm$^2$ G with carbon monoxide.

The reaction temperature was adjusted to 5° C., and while carbon monoxide was introduced to maintain the reaction pressure at 20 kg/cm$^2$ G, 1-butene and 1-octene were fed through a gaseous phase in the autoclave in a 1-octene/1-butene molar ratio of 1.6, to synthesize a mixture of fatty acid fluorides. After the feeding of the 1-butene and the 1-octene was finished, the mixture was continuously stirred until the absorption of carbon monoxide was no longer found.

The temperature inside the autoclave was adjusted to −10° C., and the pressure inside the autoclave was decreased to atmospheric pressure. Then, pentaerythritol in an amount (molar amount of hydroxyl group of pentaerythritol) equimolar to that of the carbon monoxide absorbed during the reaction was fed into the autoclave, and the mixture was allowed to react for 2 hours.

The reaction mixture was poured into ice water, washed with an alkali, and then separated into an oily layer and an aqueous layer. The oily layer was purified by distillation to give a tetraester.

The above tetraester was analyzed with a gas chromatography mass analyzer (GC-MS) to show a tetraester mixture having five kinds of molecular weights. The tetraester mixture was measured for a kinetic viscosity at 40° C. with an Ubbellohde viscometer to show 56 cst.

| | % by weight |
|---|---|
| ① Polyol ester ($R^1$~$R^4$ = $C_4$) | 0.4 |
| ② Polyol ester ($R^1$~$R^3$ = $C_4$, $R^4$ = $C_8$) | 14.3 |
| ③ Polyol ester ($R^1$~$R^2$ = $C_4$, $R^3$~$R^4$ = $C_8$) | 31.8 |
| ④ Polyol ester ($R^1$ = $C_4$, $R^2$~$R^4$ = $C_8$) | 36.0 |
| ⑤ Polyol ester ($R^1$~$R^4$ = $C_8$) | 17.5 |

Comparative Example 3

First, 1-butene was reacted with hydrogen fluoride and carbon monoxide, and then esterified with pentaerythritol, in the same apparatus as that in Example 3 under the conditions as those in Example 3, and similarly, 1-octene was reacted with hydrogen fluoride and carbon monoxide, and then esterified with pentaerythritol, whereby two kinds of tetraesters were obtained.

The above two tetraesters were mixed and adjusted such that the resultant mixture had a kinetic viscosity, at 40° C., of 56 cst. This polyol ester mixture nearly had the following composition, and the mixture had no fatty acid residue derived from butene and octene per molecule.

| | % by weight |
|---|---|
| ① Polyol ester ($R^1$~$R^4$ = $C_4$) | 30 |
| ⑤ Polyol ester ($R^1$~$R^4$ = $C_8$) | 70 |

Comparative Example 4

A four-necked flask was equipped with a stirrer, a thermometer, a nitrogen-introducing tube and a dehydration tube with a condenser.

The flask was charged with 2-methylhexanoic acid and 3,5,5-trimethylhexanoic acid in equal amounts. Then, pentaerythritol in an amount (molar amount of hydroxyl group of pentaerythritol) equimolar to the total amount of the above-charged 2-methylhexanoic acid and 3,5,5-trimethylhexanoic acid was charged into the flask.

Under the current of nitrogen, the esterification was carried out at 240° C. for 10 hours, to give a tetraester having mixed acid residues of 2-methylhexanoic acid and 3,5,5-trimethylhexanoic acid. The ester was measured for a kinetic viscosity at 40° C. to show 54 cst.

In this Comparative Example, there was obtained a tetraester having mixed acid residues from 2-ethylhexanoic acid and 3,5,5-trimethylhexanoic acid, and in the 3,5,5-trimethylhexanoic acid, carbon atoms in α-positions relative to carbonyl groups had no branch.

Table 1 shows the results of the hydrolysis resistance test of the esters obtained in Example 3 and Comparative Examples 3 and 4 and the results of the test thereof for the compatibility with refrigerant R-134a (1,1,1,2-tetrafluoroethane).

In Table 1, "acid value before test" refers to an acid value of ester immediately after the ester was produced, and "acid value after test" refers to an acid value of ester after the ester was heated for 28 days. Further, the result of "hydrolysis resistance test" shows the heat stability of ester as well since the ester was heated for a long period of time.

TABLE 1

| Example (Ex.) or Comparative Example (CEx.) | Hydrolysis Resistance test | | Compatibility test | |
|---|---|---|---|---|
| | Acid value before test mgKOH/g | Acid value after test mgKOH/g | Separation temperature on low temperature side °C. | Separation temperature on high temperature side °C. |
| Ex. 3 | 0.01 | 0.50 | −45 | 80° C. or higher |
| CEx. 3 | 0.01 | 0.70 | −15 | 80° C. or higher |
| CEx. 4 | 0.01 | 3.0 | −45 | 80° C. or higher |

What is claimed is:

1. An ester-containing lubricating oil containing, as a base oil, a mixture of polyol esters having a plurality of fatty acid residues in which alkyl groups bonding to carbonyl groups are derived from butene and octane and are linear and atoms in α-positions relative to the carbonyl groups are secondary and/or tertiary carbon atoms.

2. An ester-containing lubricating oil according to claim 1, wherein the mixture contains polyol esters of the general formula (I),

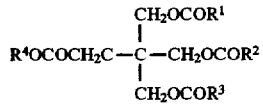

wherein each of $R^1$ to $R^4$ is an alkyl group derived from butene or octene, and all of carbons in a-positions relative to carbonyl groups are secondary or tertiary carbon atoms, each branched chain being a linear alkyl group or hydrogen, the mixture containing ① not more than 2% by weight of a polyol ester of the general formula (I) in which each of $R^1$ to $R^4$ is an alkyl group having 4 carbon atoms, ② 10 to 20% by weight of a polyol ester of the general formula (I) in which each of $R^1$ to $R^3$ is an alkyl group having 4 carbon atoms and $R^4$ is an alkyl group having 8 carbon atoms, ③ 25 to 37% by weight of a polyol ester of the general formula (I) in which each of $R^1$ and $R^2$ is an alkyl group having 4 carbon atoms and each of $R^3$ and $R^4$ is an alkyl group having 8 carbon atoms, ④ 29 to 40% by weight of a polyol ester of the general formula (I) in which $R^1$ is an alkyl group having 4 carbon atoms and each of $R^2$ to $R^4$ is an alkyl group having 8 carbon atoms and ⑤ 10 to 20% by weight of a polyol ester of the general formula (I) in which each of $R^1$ to $R^4$ is an alkyl group having 8 carbon atoms.

3. An ester-containing lubricating oil according to claim 2, wherein the mixture containing polyol esters of the general formula (I) is a product obtained by reacting pentaerythritol with a mixture of branched fatty acid fluorides formed from butene, octene, carbon monoxide and hydrogen fluoride.

* * * * *